US011377614B2

(12) United States Patent
Sung et al.

(10) Patent No.: US 11,377,614 B2
(45) Date of Patent: Jul. 5, 2022

(54) LUBRICATION BOARD

(71) Applicant: MEGAOLOGY CHEMICAL CO., LTD., Taipei (TW)

(72) Inventors: Wen-Ning Sung, Taipei (TW); Cheng-Hsi Chen, Taipei (TW); Tien-Szu Li, Taipei (TW)

(73) Assignee: MEGAOLOGY CHEMICAL CO., LTD., Taipei (TW)

( * ) Notice: Subject to any disclaimer, the term of this patent is extended or adjusted under 35 U.S.C. 154(b) by 58 days.

(21) Appl. No.: 15/931,615

(22) Filed: May 14, 2020

(65) Prior Publication Data

US 2021/0355406 A1 Nov. 18, 2021

(51) Int. Cl.
*F16C 33/12* (2006.01)
*C10M 107/44* (2006.01)
(Continued)

(52) U.S. Cl.
CPC ..... *C10M 107/44* (2013.01); *C10M 107/46* (2013.01); *C10M 2217/0453* (2013.01);
(Continued)

(58) Field of Classification Search
CPC ..... C10M 107/44; C10M 107/46; C10M 2217/0453; C10M 2221/04; C10N 2040/22; C10N 2050/08
(Continued)

(56) References Cited

U.S. PATENT DOCUMENTS

2018/0217294 A1* 8/2018 Hyuugaji ..... C10M 107/42

FOREIGN PATENT DOCUMENTS

TW I500756 B 9/2015
TW I671191 B 9/2019

* cited by examiner

*Primary Examiner* — Prem C Singh
*Assistant Examiner* — Francis C Campanell

(57) ABSTRACT

A lubrication board includes a substrate; and a lubrication layer disposed on a surface of the substrate, wherein the lubrication layer comprises a polymer expressed by formula (I) below, formula (I); wherein $R_1$ is selected from a substituted or unsubstituted $C_2$-$C_{18}$ alkyl or $C_2$-$C_{18}$ aryl; $R_2$ is selected from a substituted or unsubstituted $C_2$-$C_{18}$ alkyl or $C_2$-$C_{18}$ alkyl which is interrupted by —O—; $R_3$ is selected from —NH— or —S—; $R_4$ is selected from —$NH_2$, —OH or —SH; and n, p and q are positive integers ranging from 2 to 20000.

7 Claims, 6 Drawing Sheets

(51) Int. Cl.
*C10M 107/46* (2006.01)
*C10N 50/08* (2006.01)
*C10N 40/22* (2006.01)

(52) U.S. Cl.
CPC ..... *C10M 2221/04* (2013.01); *C10N 2040/22* (2013.01); *C10N 2050/08* (2013.01)

(58) Field of Classification Search
USPC ..... 508/103
See application file for complete search history.

LUBRICATION BOARD

BACKGROUND OF THE INVENTION

1. Field of the Invention

The present disclosure relates to lubrication boards, and in particular to a lubrication board comprising a substrate and a lubrication layer.

2. Description of the Related Art

Owing to their advancements, semiconductor technology and communication technology require that applicable materials must be in line with the trend toward lightweight, thin and compact products and process miniaturization. However, with demand for 5G communication, the Internet, and cloud services on the rise, conventional circuit board technology is no longer in line with the trend toward new generation technology. New-generation substrates attach great importance to high frequency, low loss (low Dk, Df, conductor loss, CTE), low expansion and contraction, low hygroscopicity, Tg of greater than 230° C., etc. To this end, in addition to conventional bismaleimide triazine (BT), new-generation substrates are made of materials doped with organometals, inorganic fillers, and high-rigidity resins, such as modified polyphenylene oxide (modified PPO). In view of this, the drilling processes performed on conventional circuit boards have room for improvement in service life and rigidity of a coating drill bit as well as lubrication aluminum cover technology. In this regard, the most important goals include increasing the lubrication between a coating drill bit and a board, extending the service life of the coating drill bits and the holes thus drilled, and improving the capability of the coating drill bits to lifts material up the holes and out of the way.

To increase hole precision and decrease wear and tear of drill bits, Taiwan patent I500756 discloses a heat dissipation composition, including: aqueous polyurethane dispersion solution being 20 wt %~60 wt % of the heat dissipation composition, wherein the aqueous polyurethane dispersion solution includes: a polyurethane resin whose main branch has a group and a non-ionic group which comprise polyisocyanate and polyol. The side branch of the polyurethane resin has an anion group and a non-ionic group, wherein the anion group has carboxyl, and the NCO % reaction titration value of the polyurethane resin is equal to 50% to 85% of the NCO % theoretical value; a neutralizing agent which is an alkali; and an aqueous solvent, wherein the main branch of the polyurethane resin further comprises a group formed from polysiloxane copolymer.

However, the lubrication boards of the prior art still have room for improvement in providing lubrication, improving hole precision, and extending service life of drill bits.

BRIEF SUMMARY OF THE INVENTION

An objective of the present disclosure is to provide a lubrication board to further augment the lubrication provided by the lubrication board, improve hole precision and extend service life of drill bits.

A lubrication board, comprising:

a substrate; and a lubrication layer disposed on a surface of the substrate, wherein the lubrication layer comprises a polymer expressed by formula (I) below,

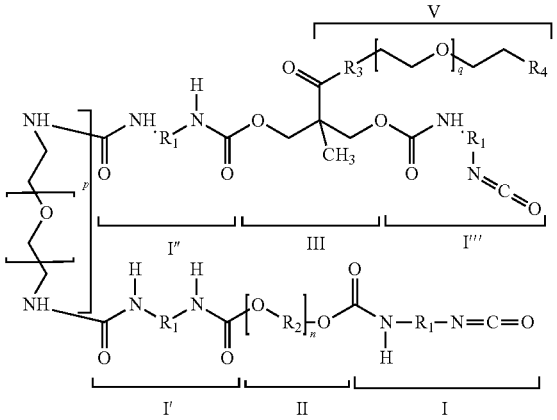

formula (I);

wherein $R_1$ is selected from a substituted or unsubstituted $C_2$-$C_{18}$ alkyl or $C_2$-$C_{18}$ aryl;

$R_2$ is selected from a substituted or unsubstituted $C_2$-$C_{18}$ alkyl or $C_2$-$C_{18}$ alkyl which is interrupted by —O—;

$R_3$ is selected from —NH— or —S—;

$R_4$ is selected from —$NH_2$, —OH or —SH; and n, p and q are positive integers ranging from 2 to 20000.

Regarding the lubrication board, in the polymer expressed by the formula (I):

structural units I, I', I'' and I''' are derived from diisocyanate;

structural unit II is derived from polyol;

structural unit III is derived from 2,2-dimethylol propionic acid;

structural unit IV is derived from amino polyethylene glycol; and structural unit V is derived from polyethylene glycol (PEG) with at least one terminal substituted by an amino group or thiol group.

Regarding the lubrication board, in the polymer expressed by formula (I): structural units I, I', I'' and I''' are derived from aliphatic diisocyanate (ADI) which comprises one to three members selected from the group consisting of isophorone diisocyanate (IPDI), 4,4'-methylene dicyclohexyl diisocyanate (H12MDI), 1,4-cyclohexane diisocyanate (CHDI), trimethyl-hexamethylene diisocyanate (TMDI), and 1,3-Bis(isocyanatomethyl)cyclohexane (H6XDI).

Regarding the lubrication board, in the polymer expressed by formula (I): structural units I, I', I'' and I''' are derived from aromatic diisocyanate.

Regarding the lubrication board, in the polymer expressed by formula (I): structural units I, I', I'' and I''' are derived from aromatic diisocyanate which comprises one or two members selected from the group consisting of toluene diisocyanate (TDI) and methylenediphenyl diisocyanate (MDI).

Regarding the lubrication board, in the polymer expressed by formula (I): structural unit II is derived from polyol. The polyol comprises one or two members selected from the group consisting of glycol (ethylene glycol), 1,2-propylene glycol, 1,4-butanediol, 1,5-diethylene glycol, 1,6-hexanediol, and 1,4-dimethylolcyclohexane.

Regarding the lubrication board, in the polymer expressed by formula (I):

structural unit V is derived from

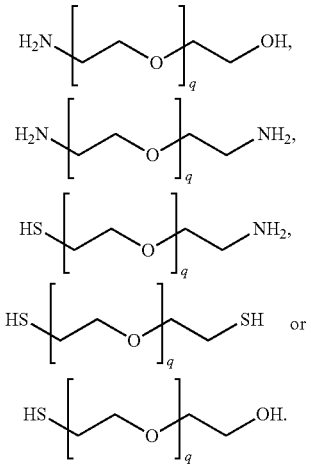

Regarding the lubrication board, the substrate is made of aluminum.

Compared with its conventional counterpart, the polymer expressed by formula (I) and included in the lubrication layer of the lubrication board of the present disclosure further augments the effect of the lubrication board of the present disclosure on providing lubrication, improving hole precision and extending service life of drill bits.

DETAILED DESCRIPTION OF THE INVENTION

Figure 1:
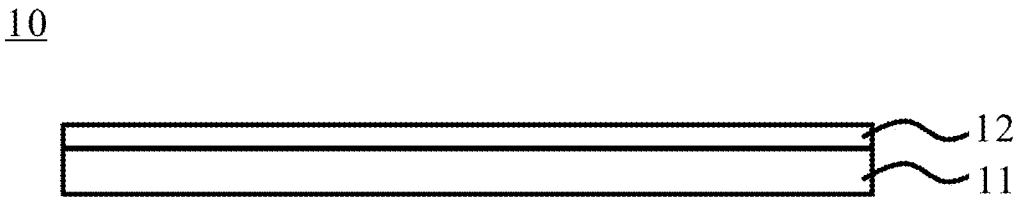
FIG. 1 is a schematic view of a lubrication board of the present disclosure.
Figure 2:
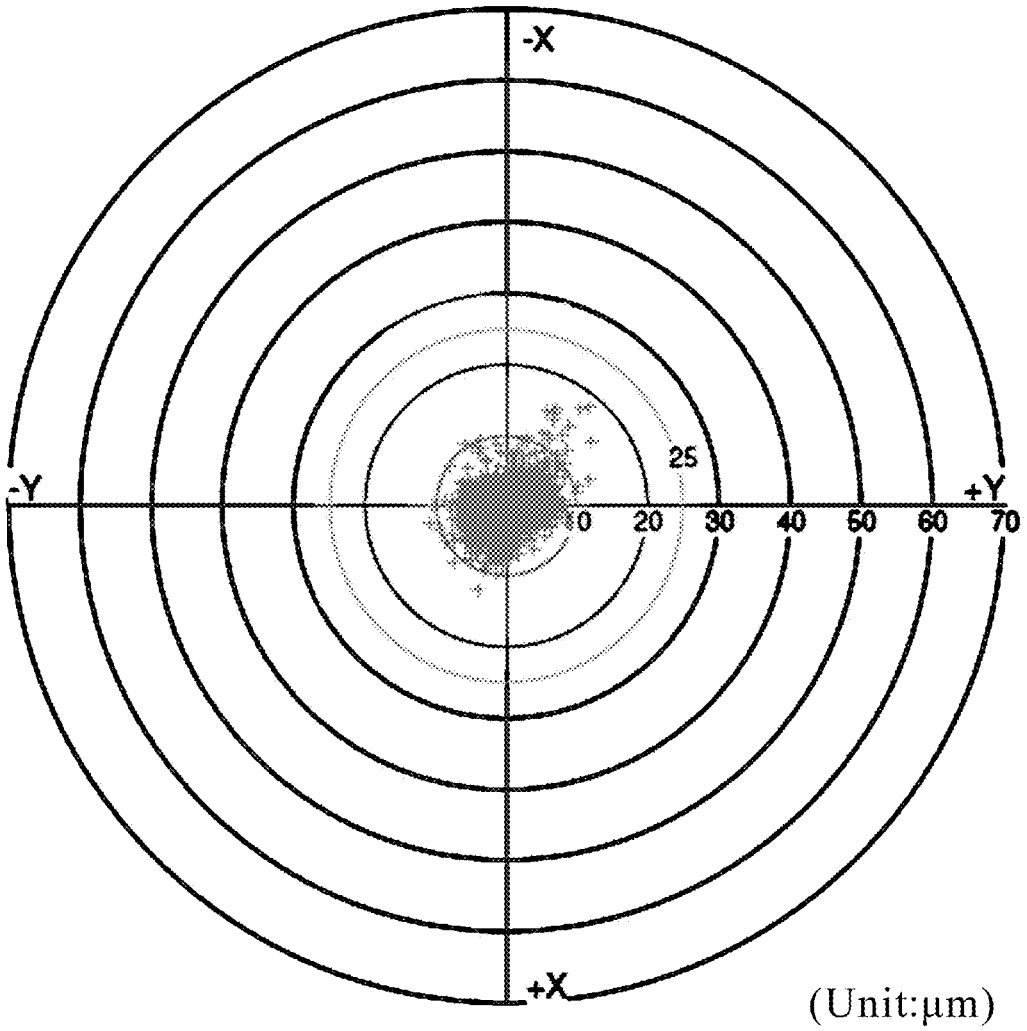
FIG. 2 is a target diagram of the lubrication board which has undergone a drilling test according to the first embodiment of the present disclosure.
Figure 3:
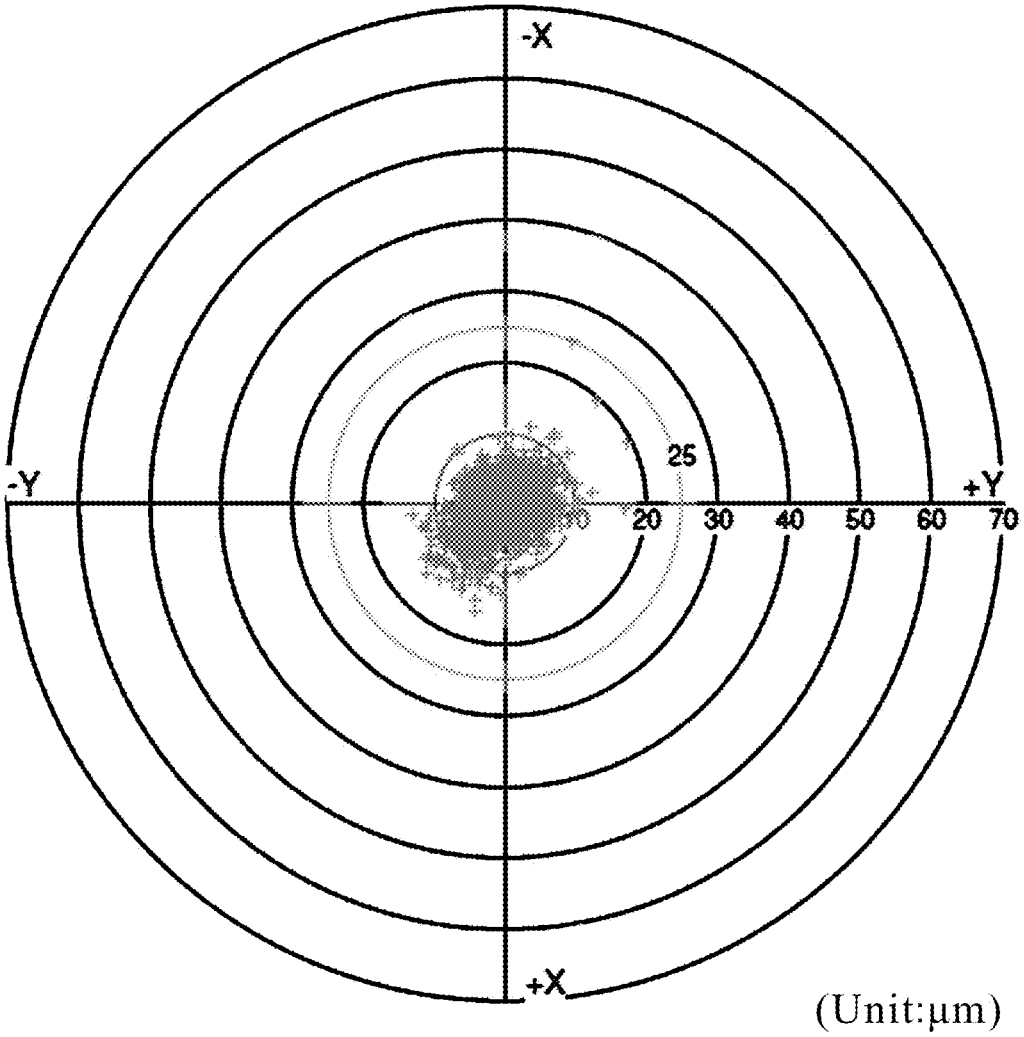
FIG. 3 ( PRIOR ART )
FIG. 3 (PRIOR ART) is a target diagram of the lubrication board which is disclosed in TW I500756 and has undergone a drilling test.
Figure 4:
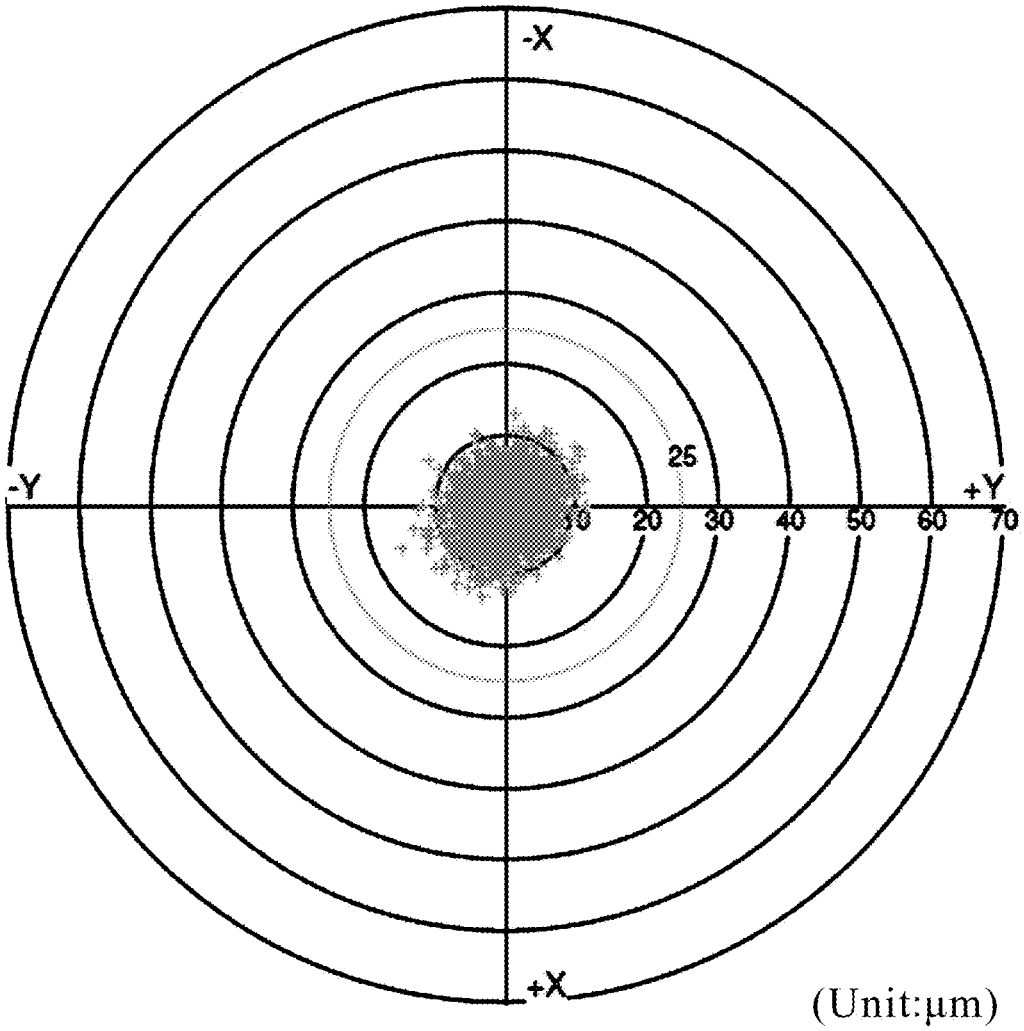
FIG. 4 ( PRIOR ART )
FIG. 4 (PRIOR ART) is a target diagram of a lubrication board which is manufactured by Mitsubishi Gas Chemical (MGC) and has undergone a drilling test.
Figure 5:
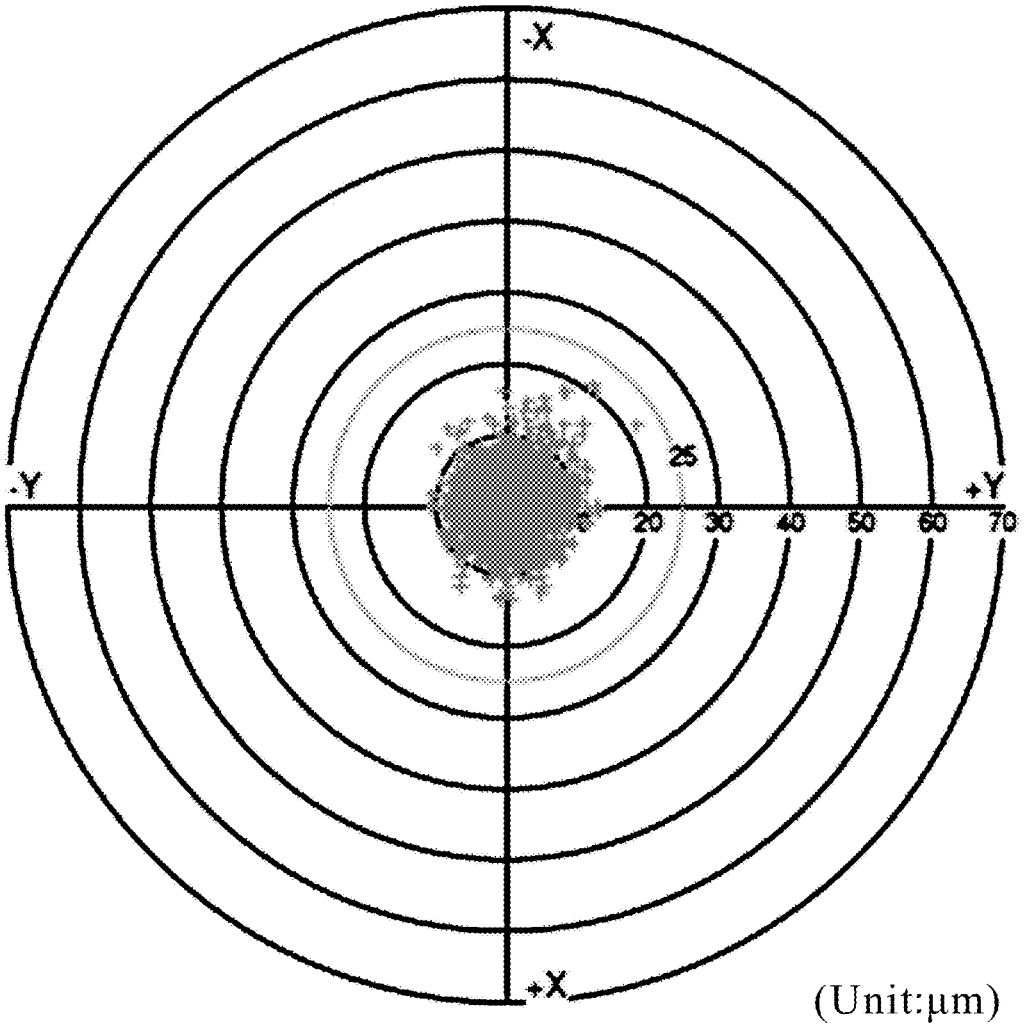
FIG. 5 ( PRIOR ART )
FIG. 5 (PRIOR ART) is a target diagram of a lubrication board which is manufactured by Uniplus and has undergone a drilling test.
Figure 6:
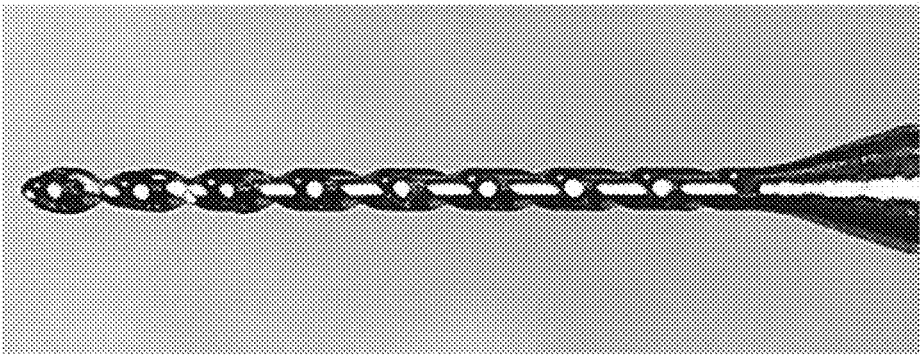
FIG. 6 is a photograph of a drill bit for performing a drilling test on the lubrication board according to the first embodiment of the present disclosure.
Figure 7:
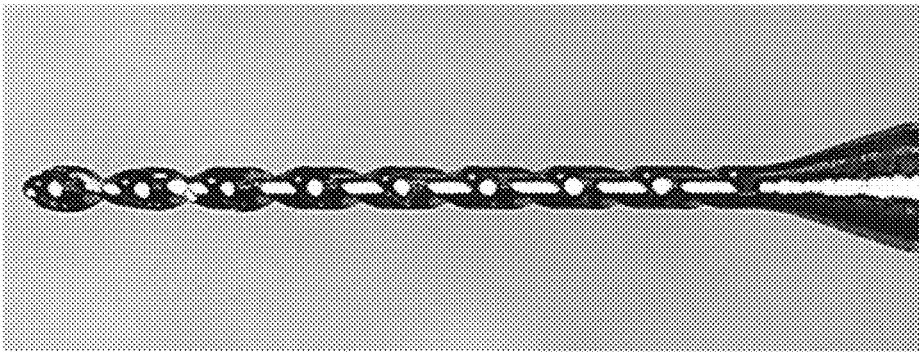
FIG. 7 ( PRIOR ART )
FIG. 7 (PRIOR ART) is a photograph of a drill bit for performing a drilling test on the lubrication board disclosed in TW I500756.
Figure 8:
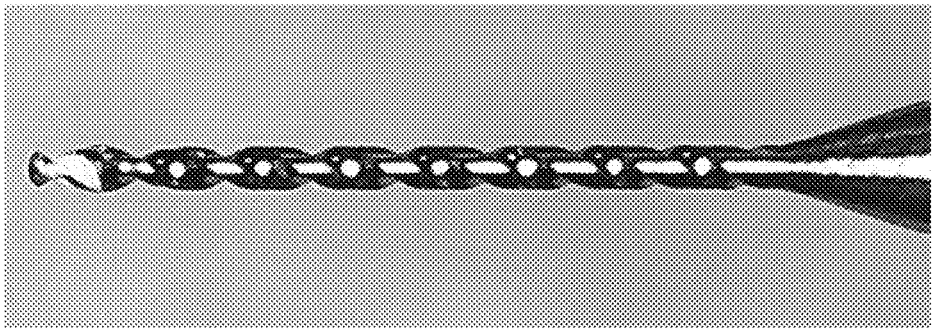
FIG. 8 ( PRIOR ART )
FIG. 8 (PRIOR ART) is a photograph of a drill bit for performing a drilling test on the lubrication board manufactured by MGC.
Figure 9:
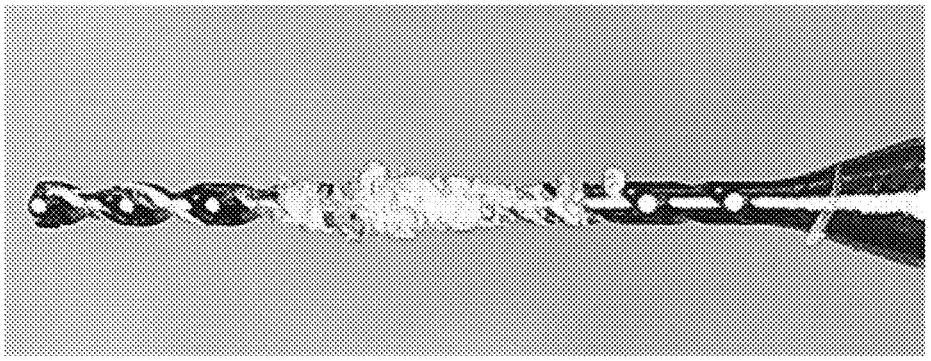
FIG. 9 ( PRIOR ART )
FIG. 9 (PRIOR ART) is a photograph of a drill bit for performing a drilling test on the lubrication board manufactured by Uniplus.

Referring to FIG. 1, a lubrication board 10 of the present disclosure comprises: a substrate 11; and a lubrication layer 12 disposed on a surface of the substrate 11. The lubrication layer 12 comprises polymer expressed by formula (I) below,

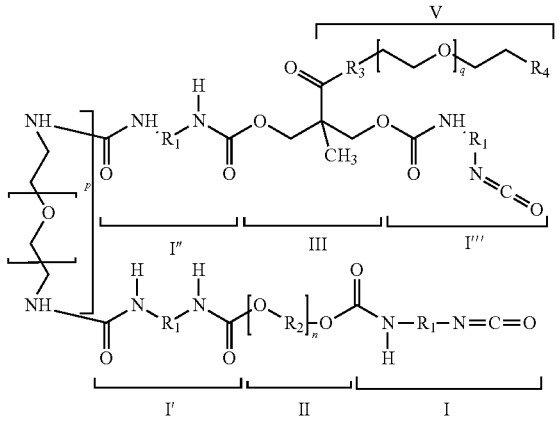

formula (I), wherein $R_1$ is selected from a substituted or unsubstituted $C_2$-$C_{18}$ alkyl or $C_2$-$C_{18}$ aryl; $R_2$ is selected from a substituted or unsubstituted $C_2$-$C_{18}$ alkyl or $C_2$-$C_{18}$ alkyl which is interrupted by —O—; $R_3$ is selected from —NH— or —S—; $R_4$ is selected from —$NH_2$, —OH or —SH; and n, p and q are positive integers ranging from 2 to 20000.

Structural units I, I', I" and I'" in the polymer expressed by formula (I) are derived from diisocyanate. The diisocyanate is aliphatic diisocyanate (ADI) or aromatic diisocyanate. When the diisocyanate is derived from aliphatic diisocyanate (ADI), the structural units I, I', I" and I'" are derived from aliphatic diisocyanate (ADI) which comprises one to three members selected from the group consisting of isophorone diisocyanate (IPDI), 4,4'-methylene dicyclohexyl diisocyanate (H12MDI), 1,4-cyclohexane diisocyanate (CHDI), trimethyl-hexamethylene diisocyanate (TMDI), and 1,3-Bis(isocyanatomethyl)cyclohexane (H6XDI). When the diisocyanate is derived from aromatic diisocyanate, the structural units I, I', I" and I'" are derived from aromatic diisocyanate which comprises one or two members selected from the group consisting of toluene diisocyanate (TDI) and methylenediphenyl diisocyanate (MDI).

The structural unit II in the polymer expressed by formula (I) is derived from polyol. The polyol comprises one or two members selected from the group consisting of glycol (ethylene glycol), 1,2-propylene glycol, 1,4-butanediol, 1,5-diethylene glycol, 1,6-hexanediol, and 1,4-dimethylolcyclohexane.

The structural unit III in the polymer expressed by formula (I) is derived from 2,2-dimethylol propionic acid.

The structural unit IV in the polymer expressed by formula (I) is derived from amino polyethylene glycol.

The structural unit V in the polymer expressed by formula (I) is derived from polyethylene glycol (PEG) with at least one terminal substituted by an amino group or thiol group. The polyethylene glycol (PEG) with the at least one terminal substituted by an amino group or thiol group is

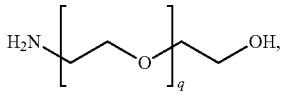

-continued

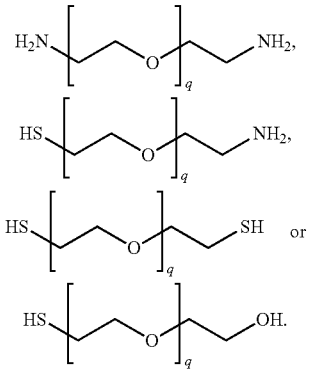

Regarding the lubrication board of the present disclosure, the substrate is made of aluminum.

The polyethylene glycol (PEG) is a major constituent of the heat dissipation composition and the lubrication board. Since the terminal hydroxyl group of polyethylene glycol (PEG) has poor reactivity, prior art requires a fundamental resin to be determined before introduction of polyethylene glycol (PEG) or requires a main branch or side branch to be connected to polyethylene glycol (PEG). In practice, if a main branch or side branch is directly connected to polyethylene glycol (PEG), aqueous polyurethane system will be so hydrophilic that gel-like by-products are likely to be produced, thereby reducing production yield. Another side effect is that the introduction of polyethylene glycol (PEG) cannot be unlimited. According to the present disclosure, polyethylene glycol (PEG) is modified by different types of terminals, such that the modified polyethylene glycol (PEG) can react with a terminal carboxyl, and the terminal can react with polyisocyanate, wherein the terminal modification allows the glycol to function as aqueous polyurethane resin main branch soft segment polyol, such that the heat dissipation composition and lubrication board manifest specificity and satisfactory uniformity, allowing each hole to be drilled and reach the constituent of the polyethylene glycol (PEG) and lifting, upon completion of the drilling process, material up the holes and out of the way to effect lubrication.

The advantage of introducing the side branch formed from the structural unit V is unlimited introduction of high-molecular-weight PEG and high-molecular-weight poly(ethylene oxide). Since the side branch extension structure is structurally identical to polyethylene glycol (PEG), the synthesized resin cannot assume gel-like appearance even when mixed, thereby increasing its stability after the mixing process.

First Embodiment: Lubrication Board of the Present Disclosure

1. A three-necked flask is pre-heated in an oil bath at 70° C. for 30 minutes. Then, 10-15 parts by weight of polyol, 20-25 parts by weight of isocyanate, 10-15% parts by weight of dimethylol propionic acid (DMPA), and 2-5% parts by weight of NH2-PEG-NH2 are introduced into the three-necked flask to undergo reaction therein at 70° C. for one hour while being stirred. The reaction continues until the measured NCO titration value is reduced to less than 50%, thereby producing the compound expressed by formula (A) below.

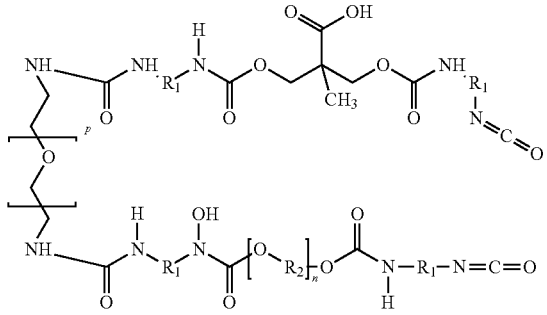

formula (A). The functional groups $R_1$~$R_2$ and the repeating unit quantity n, p in formula (A) are the same as the foregoing.

The monomers of the polyol comprise one or two members selected from the group consisting of glycol (ethylene glycol), 1,2-propylene glycol, 1,4-butanediol, 1,5-diethylene glycol, 1,6-hexanediol and 1,4-dimethylolcyclohexane. The diisocyanate comprise one or three members selected from the group consisting of toluene diisocyanate (TDI), methylenediphenyl diisocyanate (MDI), isophorone diisocyanate (IPDI), 4,4'-methylene dicyclohexyl diisocyanate (H12MDI), aliphatic diisocyanate (ADI), 1,4-cyclohexane diisocyanate (CHDI), trimethyl-hexamethylene diisocyanate (TMDI), and 1,3-Bis(isocyanatomethyl)cyclohexane (H6XDI).

2. Introduce 2-5 parts by weight of polyethylene glycol (PEG) whose terminals are modified by amino groups, that is, $NH_2$-PEG-$NH_2$

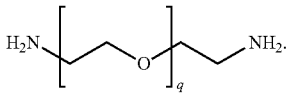

$NH_2$-PEG-$NH_2$ is introduced subsequently, because $NH_2$-PEG-$NH_2$ must be formed on a side branch. In this embodiment, q is 12.

In step 2, the terminal-modified polyethylene glycol (PEG) will not be restricted to $NH_2$-PEG-$NH_2$, provided that its two ends are nucleophilic; consequently, it can be $NH_2$-PEG-OH

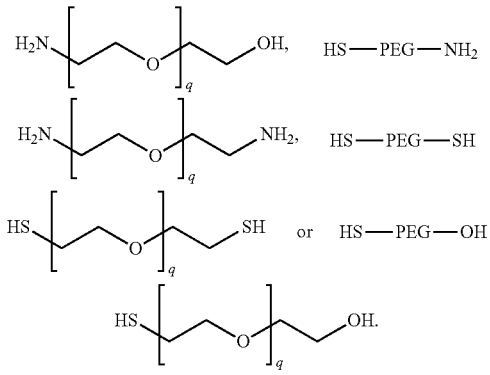

3. After the reaction has lasted two hours, the reaction takes place at 90° C. for 30 minutes. As soon as the measured NCO titration value decreases to less than 40%, a mixture of the polymer expressed by formula (I) below is produced.

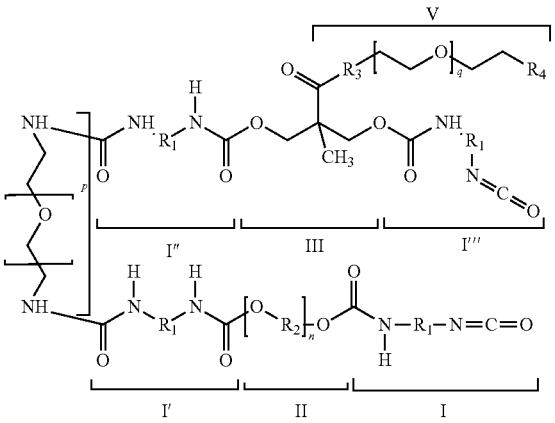

formula (I). The functional groups $R_1$~$R_4$, structural units and the repeating unit quantity n, p, q in formula (I) are the same as the foregoing.

Afterward, water is added to the mixture and stirred at high speed (1200 rpm) to effect emulsification and thus produce an emulsion. The stirring process is carried out by ultrasonic vibration or mechanically. The amount of the water added is adjustable according to the contents of aforesaid constituents.

4. Coat the emulsion produced in step 3 on an aluminum substrate. Then, dry the coated emulsion to produce the lubrication board of this embodiment.

Regarding the polymer of formula (I), since the side branch has $NH_2$-PEG-$NH_2$, such that the side branch has the hydrophilicity of the polyethylene glycol (PEG) to substitute for (triethyl)amine (TEA). The TEA is toxic, pungent and risky to operate; consequently, all the heat dissipation compositions have PEG content, allowing each part to take part in drilling lubrication and react with water to form a stable aqueous emulsion.

The aqueous polyethylene glycol (PEG) solution can be added, in an unlimited manner, to the emulsion produced in step 3 and thus into modified polyurethane (PU), so as to further enhance drilling lubrication and regimen adjustability.

Exemplary Test

This exemplary test involves testing the hole precision of the lubrication board of the first embodiment of the present disclosure when applied to a drilling process performed on printed circuit boards (PCB), using the lubrication board disclosed in Taiwan patent I500756, the lubrication board purchased from Mitsubishi Gas Chemical (MGC), and the lubrication board purchased from Uniplus as control groups.

The hole precision (hole position accuracy) is described below.

1. The hole precision is about how well the drilled holes are aligned. The purpose of drilling holes in a substrate is to connect circuits and/or to fix the substrate in place (to a die) (to connect upper and lower circuits on a dual-sided board, wherein a multilayered board has an additional inner layer, thereby connecting the first, second, third, fourth, fifth, sixth . . . layers). In general, the hole precision relies upon measurement performed on the board.

2. This exemplary test requires a tool of testing hole precision—hole precision measurement instrument (automated optical inspection, AOI).

3. How to test hole precision—6δ (six standard deviations)—because one drilling program involves at least 40,000 to 60,000 holes, distributed and concentrated. The automated optical inspection (AOI) instrument performs differentiation by a program of 66 and then determines whether the holes thus drilled fall within or outside a predetermined range (Cpk≥1.33 or Cpk<1.33). In the event of the latter, the board must be discarded. Cpk 1.33 is an index employed by circuit board manufacturers to determine whether the finished products are satisfactory or unsatisfactory. During the drilling process performed on a circuit board, the closer a hole is to the center, the greater the Cpk value is. Given Cpk≥1.33, the circuit board manufacturers determine that the circuit board is satisfactory. Given Cpk<1.33, the hole has an overly large deviation value, and thus the circuit board is considered unsatisfactory and discarded and thus inapplicable to subsequent processes.

Basically, Cpk is a numeral without any unit. Furthermore, Cpk can also be regarded as an index to process capability Cp (precision). The letter "k" in Ck arises from the pronunciation of "か" in the Japanese expression "かたより". Ck is also known as Ca (accuracy). In other words, Cpk is about both precision and accuracy.

Furthermore, Cpk also denotes a probability of normal distribution, assuming that the specification center does not deviate from the population center. Consequently, if the product meets the criterion Cpk=1.33, only 63~66 out of every million products are unsatisfactory, thereby striking a good balance as far as optimal economic efficiency of modern industrial manufacturing is concerned.

Drilling parameters are described below.

Drilling parameters are mechanical parameters about the through holes drilled in a circuit board with a drill bit of a drilling tool. Common drilling parameters are as follows:

1. Rotation speed S: rotation speed of the axle (number of revolutions per minute, rpm).

2. Feed speed F: speed of downward (in direction Z) movement (m/min).

3. Chip load: volume of material broken off in each revolution; chip load=feed speed F/rotation speed S.

Drilling conditions for this exemplary test are enumerated in Table 1 below.

TABLE 1

| drilling conditions for this exemplary test<br>drilling condition | |
|---|---|
| cover thickness (mm) | 0.1 |
| drilling tool model number | HITACHI ND-IS212E |
| hole precision measurement instrument (AOI) | HITACHI HA-1AME |
| substrate model number | 832NX |
| board thickness (mm) | 0.15 |
| stack number | 4 |
| drilling diameter (mm) | 0.105 |
| knife length (mm) | 1.8 |
| drill bit brand | Union |
| drill bits model number | KCW-Z406AW |
| rotation speed K (rpm) | 300 |
| feed speed (m/min) | 3 |
| withdrawal speed (m/min) | 50 |
| service life of drill bit (hits) | 3000 |
| lower cushion board | t = 1.5 |
| program pitch (mm) | 0.3 |

The results of this exemplary test are shown in FIG. 2~FIG. 9 and Table 2~Table 6 below.

TABLE 2 results of the drilling test performed on the lubrication board in the first embodiment

| | X | Y | D | DD |
|---|---|---|---|---|
| Max. | 0.012 | 0.012 | −0.003 | 0.018 |
| Min. | −0.014 | −0.011 | −0.023 | 0.000 |
| Ave. | 0.0000 | 0.0000 | −0.053 | 0.0033 |
| \|Ave.\| + 3SD | 0.0076 | 0.0088 | 0.0077 | 0.0093 |
| CP | 3.280 | 2.837 | 10.577 | 3.626 |
| Cpk (A) | 4.861 | 2.951 | 13.335 | 4.473 |

TABLE 3 results of the drilling test performed on the lubrication board disclosed in Taiwan patent I500756

| | X | Y | D | DD |
|---|---|---|---|---|
| Max. | 0.015 | 0.017 | −0.003 | 0.025 |
| Min. | −0.023 | −0.013 | −0.017 | 0.000 |
| Ave. | 0.0000 | 0.0000 | −0.049 | 0.0037 |
| \|Ave.\| + 3SD | 0.0089 | 0.0096 | 0.0071 | 0.0108 |
| CP | 2.800 | 2.597 | 11.520 | 3.010 |
| Cpk (A) | 4.309 | 3.337 | 13.738 | 4.231 |

TABLE 4 results of the drilling test performed on the lubrication board purchased from Mitsubishi Gas Chemical (MGC)

| | X | Y | D | DD |
|---|---|---|---|---|
| Max. | 0.013 | 0.011 | −0.003 | 0.016 |
| Min. | −0.013 | −0.015 | −0.020 | 0.000 |
| Ave. | 0.0000 | 0.0000 | −0.0053 | 0.0048 |
| \|Ave.\| + 3SD | 0.0113 | 0.0112 | 0.0079 | 0.0118 |
| CP | 2.208 | 2.237 | 9.377 | 2.892 |
| Cpk (A) | 3.242 | 3.061 | 12.737 | 3.458 |

TABLE 5 results of the drilling test performed on the lubrication board purchased from Uniplus

| | X | Y | D | DD |
|---|---|---|---|---|
| Max. | 0.013 | 0.018 | −0.003 | 0.022 |
| Min. | −0.017 | −0.011 | −0.025 | 0.000 |
| Ave. | 0.0000 | 0.0000 | −0.0053 | 0.0045 |
| \|Ave.\| + 3SD | 0.0112 | 0.0108 | 0.0086 | 0.0122 |
| CP | 2.233 | 2.319 | 7.532 | 2.663 |
| Cpk (A) | 2.692 | 2.446 | 11.163 | 2.989 |

The parameters used in Table 2~Table 5 are defined as follows:

X: deviation of origin in direction X

Y: deviation of origin in direction Y

D: theoretical, actual difference in drilling diameter

DD: integrated computation of X, Y, D weights

Max. value: maximum value of deviation of center

Min. value: minimum value of deviation of center

Ave. value: average value of deviation of center

|Ave.|+3SD: average value+three standard deviations process capability precision CP: it expresses how consistent the process characteristics are; the larger the CP is, the more concentrated the process characteristics are; the smaller the CP is, the more distributed the process characteristics are.

integrated process capability Cpk: it gives considerations to both the deviation and consistency of process characteristics; the larger the Cpk is, the better the integrated capability is.

TABLE 6

Cpk value of lubrication board

| first embodiment | Taiwan Patent I500756 | MGC | Uniplus |
|---|---|---|---|
| 4.473 | 4.231 | 3.458 | 2.989 |

As shown in Table 2~Table 6, compared with the lubrication board disclosed in Taiwan patent I500756 and commercially-available lubrication boards, the lubrication board in the first embodiment of the present disclosure underwent a drilling process and has a larger Cpk value, indicating that it has higher hole precision.

Referring to the target diagrams of FIG. 2~FIG. 5, compared with the lubrication board disclosed in Taiwan patent I500756 and commercially-available lubrication boards, the lubrication board in the first embodiment of the present disclosure has more concentrated points of drilling during the drilling test.

Referring to the photographs of a drill bit in FIG. 6~FIG. 9, no residual material is found on the lubrication board in the first embodiment of the present disclosure and the lubrication board disclosed in Taiwan patent I500756, which have undergone drilling drill bits. By contrast, the lubrication board of Mitsubishi Gas Chemical (MGC) has undergone drilling, and the head of its drill bit has residual material. The lubrication board of Uniplus has undergone drilling, and the head of its drill bit has much more residual material. The residual materials attached to the drill bits have negative effect on the service life thereof.

Therefore, the lubrication board of the present disclosure comprises a lubrication layer which comprises the polymer expressed by formula (I) and thus further enhances the effect of the lubrication board on providing lubrication, enhancing hole precision and extending the service life of drill bits.

While the present disclosure has been described by means of specific embodiments, numerous modifications and variations could be made thereto by those skilled in the art without departing from the scope and spirit of the present disclosure set forth in the claims.

What is claimed is:

1. A lubrication board, comprising:

a substrate; and a lubrication layer disposed on a surface of the substrate, wherein the lubrication layer comprises a polymer expressed by formula (I) below,

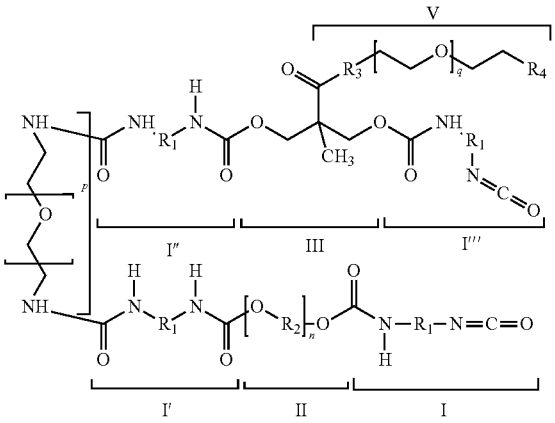

formula (I);

wherein $R_1$ is selected from a substituted or unsubstituted $C_7$-$C_{18}$ aryl;

$R_2$ is selected from a substituted or unsubstituted $C_2$-$C_{18}$ alkyl or $C_2$-$C_{18}$ alkyl which is interrupted by —O—;

$R_3$ is selected from —NH— or —S—;

$R_4$ is selected from —$NH_2$, —OH or —SH; and n, p and q are positive integers ranging from 2 to 20000.

2. The lubrication board of claim 1, wherein in the polymer expressed by formula (I):

structural units I, I', I" and I'" are derived from diisocyanate;

structural unit II is derived from polyol;

structural unit III is derived from 2,2-dimethylol propionic acid;

structural unit IV is derived from amino polyethylene glycol; and structural unit V is derived from polyethylene glycol (PEG) with at least one terminal substituted by an amino group or thiol group.

3. The lubrication board of claim 2, wherein in the polymer expressed by formula (I):

the structural units I, I', I" and I'" are derived from aromatic diisocyanate.

4. The lubrication board of claim 3, wherein in the polymer expressed by the formula (I):

the structural units I, I', I" and I'" are derived from aromatic diisocyanate which comprises one or two members selected from the group consisting of toluene diisocyanate (TDI) and methylenediphenyl diisocyanate (MDI).

5. The lubrication board of claim 2, wherein, in the polymer expressed by the formula (I), the structural unit II is derived from polyol, and the polyol comprises one or two members selected from the group consisting of glycol (ethylene glycol), 1,2-propylene glycol, 1,4-butanediol, 1,5-diethylene glycol, 1,6-hexanediol, and 1,4-dimethylolcyclohexane.

6. The lubrication board of claim 2, wherein, in the polymer expressed by the formula (I), the structural unit V is derived from

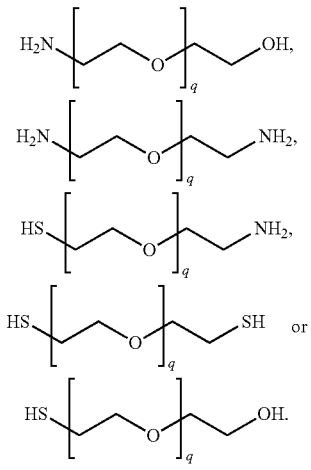

7. The lubrication board of claim 2, wherein the substrate is made of aluminum.

* * * * *